US005519363A

United States Patent [19]

Boudreau et al.

[11] Patent Number: 5,519,363

[45] Date of Patent: May 21, 1996

[54] CONTROLLED IMPEDANCE LINES CONNECTED TO OPTOELECTRONIC DEVICES

[75] Inventors: Robert A. Boudreau, Hummelstown; Hongtao Han, Mechanicsburg; Ping Zhou, Middletown, all of Pa.

[73] Assignee: The Whitaker Corporation, Wilmington, Del.

[21] Appl. No.: 251,061

[22] Filed: May 31, 1994

[51] Int. Cl.[6] ..... H01P 3/08

[52] U.S. Cl. ..... 333/1; 333/238

[58] Field of Search ..... 333/33, 161, 236, 333/238, 246

[56] References Cited

U.S. PATENT DOCUMENTS

| | | | |
|---|---|---|---|
| 3,879,690 | 4/1975 | Golant et al. | 333/238 X |
| 3,882,396 | 5/1975 | Scheider | 333/248 X |
| 4,034,468 | 7/1977 | Koopman . | |
| 4,067,104 | 1/1978 | Tracy . | |
| 4,210,923 | 7/1980 | North et al. . | |
| 4,402,004 | 8/1983 | Iwasaki . | |
| 4,499,659 | 2/1985 | Varteresian et al. | 29/589 |
| 4,509,096 | 4/1985 | Baldwin et al. . | |
| 4,536,469 | 8/1985 | Adlerstein | 430/314 |
| 4,561,011 | 12/1985 | Kohara et al. . | |
| 4,589,116 | 5/1986 | Westermeier | 372/36 |
| 4,644,093 | 2/1987 | Yoshihara et al. | 333/238 X |
| 4,675,620 | 6/1987 | Fullerton | 333/1 |
| 4,680,557 | 7/1987 | Compton | 333/1 |
| 4,762,382 | 8/1988 | Husain et al. . | |
| 4,788,627 | 11/1988 | Ehlert et al. . | |
| 4,803,450 | 2/1989 | Burgess et al. | 333/238 |
| 4,853,660 | 8/1989 | Schloemann | 333/204 |
| 4,951,123 | 8/1990 | Lee et al. . | |
| 5,285,570 | 2/1994 | Fulinara | 333/238 X |
| 5,442,330 | 8/1995 | Fuller et al. | 333/204 |

FOREIGN PATENT DOCUMENTS

| | | | |
|---|---|---|---|
| 2497410 | 2/1982 | France . | |
| 2753546 | 7/1979 | Germany . | |
| 50702 | 4/1980 | Japan | 333/238 |
| 284501 | 12/1987 | Japan | 333/238 |
| 63-176001 | 7/1988 | Japan . | |

OTHER PUBLICATIONS

*IEE Proceedings;* "Design and Layout of Microstrip Structures"; vol. 135; No. 3; Jun. 1988.

*Electronics Letters;* "Dispersionless Coupled Microstrip Over Fused Silica–Like Anisotropic Substrates"; vol. 12; No. 22; Oct. 1976.

European Search Report; Application No. EP 95 30 3537. 1 Sep. 1995.

*Primary Examiner*—Paul Gensler

*Attorney, Agent, or Firm*—William S. Francos

[57] ABSTRACT

A dielectric substrate of a material such as silicon is used to provide controlled impedance waveguides for coupling an optoelectronic device to an electronic device. The impedance is controlled by varying the thickness of the dielectric between the signal lines and the ground plane. In the preferred embodiment, the crystallographic structure of the silicon is employed to achieve great precision of the dielectric thickness.

9 Claims, 3 Drawing Sheets

CONTROLLED IMPEDANCE LINES CONNECTED TO OPTOELECTRONIC DEVICES

FIELD OF THE INVENTION

The invention relates to using high electrical impedance silicon as the dielectric medium for signal transmission of electro-optic transmitters and receivers. The method used enables accurate impedance control of the transmission lines at low cost to the manufacturer.

BACKGROUND OF THE INVENTION

The advent of optoelectronics and their potential to impact the communications industry has posed the problem to the manufacturing community to develop effective and cost efficient products to couple optoelectronic devices to end-user products such as computers and telecommunications equipment. The optoelectronic devices are for example optical transceivers which convert electrical signals to and from optical signals for communications frequencies in the gigahertz and megahertz frequency bands. As is well known to the skilled communications engineer, a crucial factor to transmission line/device interconnection is impedance matching. If the device and transmission line characteristic impedance are not properly matched, undesirable back-reflection results which significantly interferes with the effective transmission of data. To be specific, reflection due to impedance mismatch will result in interference of the signal carried to and from the device causing attenuation or distortion of the signal amplitude if the interference is destructive. This problem with interference with the reflected wave is dramatically pronounced in high frequency applications. For example, consider microprocessors which generate and receive digital pulses with extremely fast rise and fall times and operate in the 300 MHz to 1 GHz band. The skilled artisan will understand that the greater the frequency of the digital pulse, the greater the number of frequency components required to be mixed to effect the desired square pulse. This is particularly true the sharper the rise and fall times of the pulse. This follows by simple Fourier analysis. Clearly, in a such a system requiring a delicate mix of frequency components, any undesired components will result in an undesired waveform. As can be understood, the higher the frequency band in which devices operate, the more pronounced the ill-effects of reflection become. To be sure, as engineers attempt to increase data rates by using transmission frequencies in the microwave and millimeter wave spectral range, the ill-effects of reflection due to impedance mismatch are a true barrier to effective communication systems.

One technique of providing an easily manufactured, high frequency transmission line is disclosed in U.S. Pat. No. 4,680,557, to Compton and is incorporated herein by reference. Compton discloses the use of conventionally sized dielectric ribbon which provides high impedance and low distortion transmission line links between high frequency devices. Microstrip transmission line is fabricated by attaching thin metal strips to either side of the dielectric, with one side of parallel strips acting as signal lines and parallel strips acting as ground planes on the other side. Finally, the strips on either side are staggered so as to be offset relative to those on the opposite side of the ribbon. This can be seen in FIGS. 2 and 3 of the '557 reference. By utilizing this structure, the distance between the signal and ground lines is increased per given thickness of the dielectric, thereby decreasing the characteristic capacitance between the signal and ground lines to a negligible value. Furthermore, the effective width of the signal lines is increased as well. This enables high impedance transmission lines to be employed in parallel with some degree of control over the characteristic impedance of the waveguide. However, this flexibility is limited to the dimensional spacing of the strips as well as the intrinsic impedance of the dielectric ribbon. Furthermore, the reference does not disclose a structure capable of having mounted thereon an optoelectronic device. What is needed is a structure capable of having mounted or formed thereon an optoelectronic device as well as transmission lines for connecting to the device. The characteristic impedance of the transmission lines needs to be controllable to enable connection to various devices of differing characteristic impedances and the signal lines need to be of a dimension that enables easy electrical connection.

SUMMARY OF THE INVENTION

Accordingly, it is an object of this invention to provide a controllable impedance transmission line interconnect for coupling optoelectronic devices to electrical systems. The invention utilizes a substrate of a given thickness upon which is deposited conductive signal lines on one surface and a ground plane on the parallel surface on the other surface of the substrate. The substrate is a dielectric material preferably of a high intrinsic electricity resistivity and the signal line impedance is controlled by varying the distance between signal line and ground plane. This distance is varied by etching the substrate by various standard etching techniques, as will be described further herein.

It is a further object of the invention to utilize silicon as the dielectric substrate of the waveguide. Particularly, by etching the silicon substrate along preferred crystallographic planes, the thickness of the dielectric between the signal lines and the ground plane can be controlled with great precision. Because the impedance of the waveguide is dependent upon the thickness of the dielectric, the impedance is controlled with great precision as well.

It is yet another object of the invention to directly fabricate optoelectronic devices directly on the silicon substrate.

DETAILED DESCRIPTION OF THE INVENTION

For the purposes of illustration, emphasis will be made herein on a particular optoelectronic device/electromagnetic waveguide interconnection via a processed substrate of very high resistance silicon. Other semiconductor substrate materials are considered within the purview of the skilled artisan. Furthermore, silica is considered a useful dielectric material from which to form the substrate.

Figure 2:
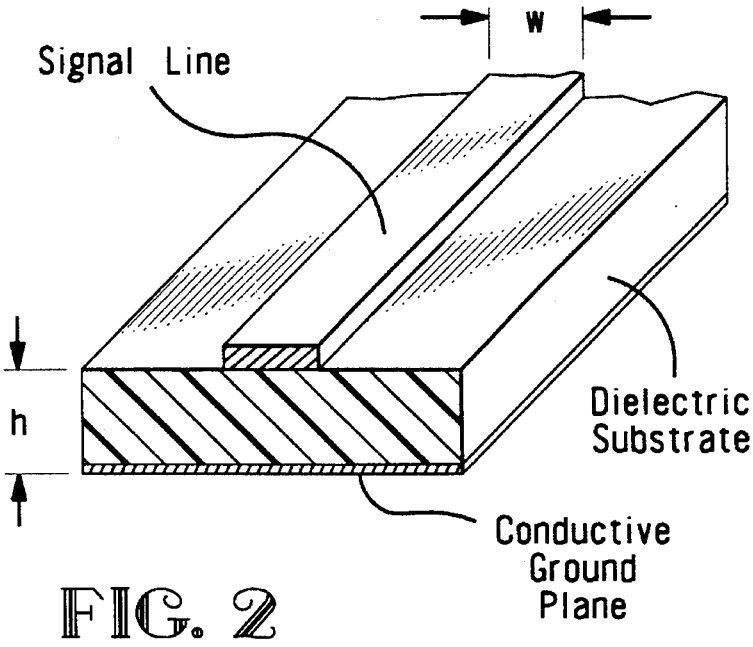
FIG. 2 shows a typical asymmetrical or microstrip waveguide.

Microstrip waveguide theory and practice has enjoyed great use in the communication industry over the past few decades. With the advent of optoelectronics, a need has developed for an inexpensive, reliable optoelectronic interconnect for coupling between an optoelectronic device and high speed digital circuitry. Use of microstrip waveguides in this interconnection is promising, and this invention teaches a new use of silicon waferboard technology to effect the optoelectronic/microstripline/high speed digital circuitry interconnection. Turning to FIG. 2, we see a common example of microstrip transmission line. The microstrip transmission line has a characteristic impedance given by:

$$Z_o=377\ (E_r)^{-0.5}\ (h/w)\ \{1+1.735E_r^{-0.0724}\ (w/h)^{-0.836}\}^{-1}$$

where w is the width of the signal transmission, h is the distance between the signal and the ground plane and $E_r$ is the dielectric constant of the insulative layer between the transmission line and the ground plane. As stated, the use of silicon as a substrate for the waveguide has advantages due to the fabrication processes which are well known to the skilled artisan. However, the deposition of a metal ground plane on the top surface of the substrate, followed by the deposition of a dielectric layer and the deposition of a signal line to form a microstrip waveguide is not practical in effecting a good impedance match between the microstripline and 50 ohm devices. This is due to the fact that in order to fabricate a 50 ohm transmission line, w in the above equation turns out to be unsatisfactorily small for a thickness of dielectric, h, of about 1 micron. Calculations show that the width of the microstripline to create a 50 ohm microstrip transmission line would be on the order of 10 kAngstroms or roughly 1 micron. This is not a practical width as connections between the microstripline and devices are poor with such physically small dimensions.

However, the use of silicon as the dielectric layer allows for high electrical resistivity (approximately $10^4$ ohm/cm), readily. To be more precise, by utilizing the silicon substrate as the dielectric layer between the signal line and the ground plane, impedance matching between 50 ohm devices is readily effected. The present invention is the alteration of the thickness of the dielectric layer of silicon, h in the above equation, to produce a 50 ohm microstrip transmission line, and yet enabling a microstripline width, w, of a practical dimension. The thickness of the silicon can be altered to create an impedance line of any desired value, and 50 ohms is discussed only as an example. By way of example, a standard silicon wafer of thickness of 375 microns, etched to provide a dielectric layer of thickness 125 microns, the width of the signal line is on the order of 100 microns provides the desired 50 ohm line.

Figure 3:
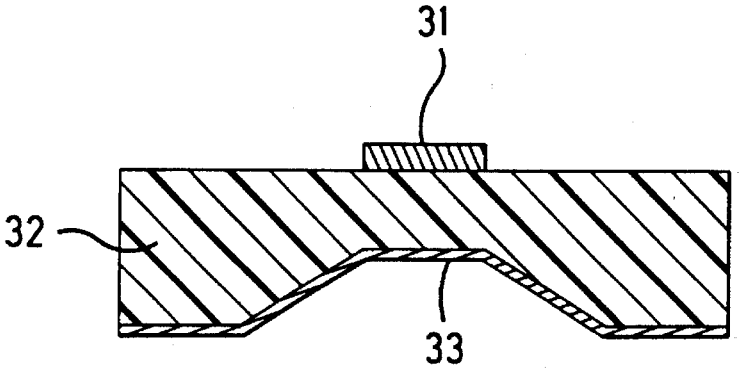
FIG. 3 shows a view of the etched trapezium shaped groove on one surface of the substrate with a conductive ground plane deposited thereon and a signal line deposited on the flat surface of the substrate.

The fabricated microstripline is shown in closer view in FIG. 3. The signal line 31 is of a given width, w. The dielectric 32 is of a thickness, h, as shown and its dimension is chosen to obtain the required impedance of the transmission line. Finally the ground plane 33 is deposited on the bottom of the substrate line to form a waveguide. The process for etching the silicon dielectric 32 is discussed presently.

Figure 1:
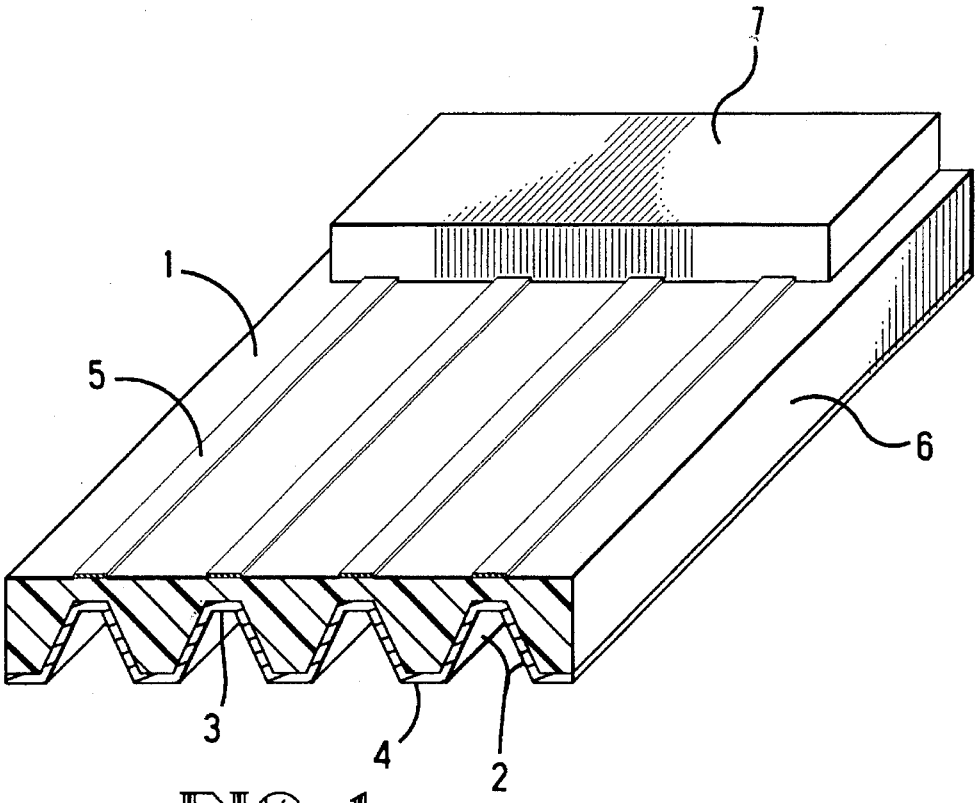
FIG. 1 shows an optoelectronic device mounted on the signal line interconnect.

The dielectric substrate is in this example silicon, but this is only for exemplary purposes, as other materials can be used. The critical factor is that for silicon the crystalline planes can be exposed by known etching techniques. For example, as is shown in FIG. 1, the top surface 1 of the silicon waferboard is in the (100) crystalline plane, with an optoelectronic device 7 mounted thereon. While the substrate 6 as shown is a discrete element, because it is made of silicon, it is clear that a device 7 could be fabricated by epitaxial growth and doping techniques well known in the art.

In this particular case the (100) substrate is processed to produce the necessary physical dimensions. It is then photolithographically masked by applying masks with openings aligned to the crystallographic planes. To this end, masking materials such as silicon nitride, silicon dioxide or special polymer materials are grown, spin coated or deposited on the substrate. Next a photoresist is applied to the top of the masking material by spin coating, followed by photolithographically defining and patterning the photoresist layer. The photoresist pattern is transferred to the masking material by wet and dry etching techniques. Finally, an anisotropic etchant is applied and the unmasked (100) surfaces etch rapidly until the (111) family of crystal planes is revealed. Typical anisotropic etchants are KOH, ammonium hydroxide, tetramethyl ammonium hydroxide, hydrazine and ethylenediamine-pyrocatechol-water. As is well known, this etching process is a slow, self-limiting one, and the depth of the etch can be controlled by merely choosing an appropriate mask opening width. For further description of the etching process, see U.S. patent application Ser. No. 08/198,028, now U.S. Pat. No. 5,420,953, and U.S. Pat. No. 4,210,923, both incorporated herein by reference. Normally, the etching will create (111) planes that form a v-shaped groove. In order to effect the (111) planes 2, with a surface 3 which is parallel to the top surface of the substrate, the etching process is halted prematurely. At this point, a metal layer 4 is deposited to create the ground plane needed. The signal lines 5 are then deposited. This deposition of metal to create signal lines and a ground plane is effected by vapor deposition such as sputtering or evaporation, techniques which are well known in the art. The metal deposition could also be effected by standard plating techniques. Finally, the technique of etching the crystalline substrate to reveal the desired crystalline planes is a precise one, and thereby the thickness, h, is controlled with great precision. By virtue of this, the impedance of the transmission line is controlled to a desired level with great precision as well.

In another embodiment of the invention, the dielectric substrate is made of silica, and the crystallography of the silica is not utilized. Rather, a reactive ion etching process or a wet chemical etch is employed to create the grooves in the silica. Conductive layers are deposited to form the ground plane and signal lines. The depth of the grooves are controlled to effect the desired thickness of the dielectric, and thereby the impedance.

Figure 4:
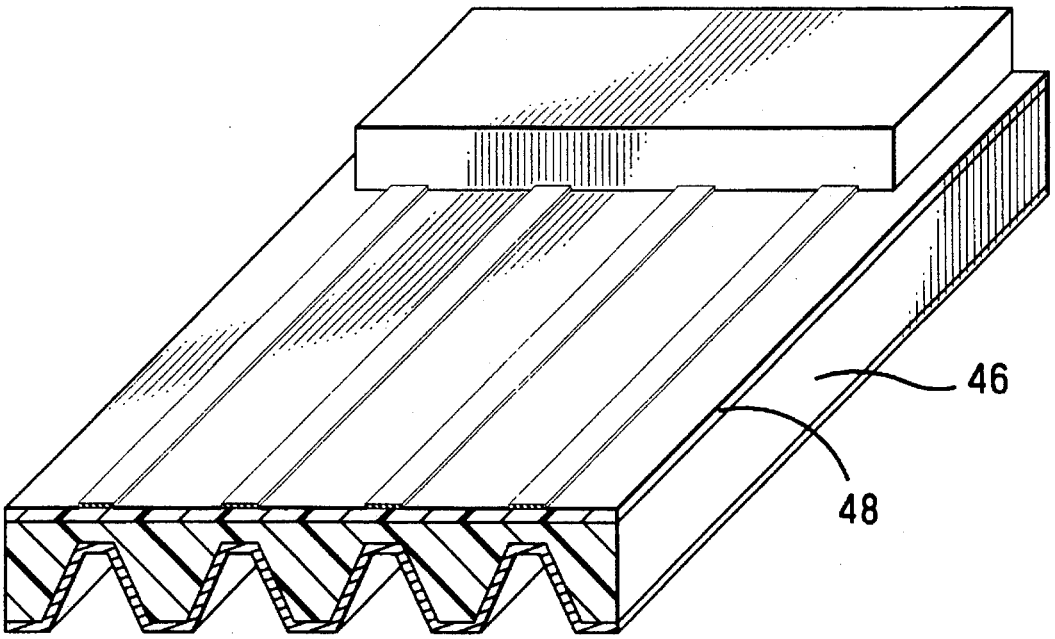
FIG. 4 shows an alternative embodiment of the present invention in which an additional layer or layers of dielectric are deposited to create a stack that acts like a single layer of dielectric.

Another embodiment is shown in FIG. 4, which is nearly identical in structure to that shown in FIG. 1. In this embodiment an additional layer or layers of dielectric material 48 are deposited on the substrate 46 to create a stack that acts as a single dielectric. In the example shown in FIG. 4, the ground plane 44 is on the bottom of the substrate. However, it is clearly within the purview of the skilled artisan to establish a ground layer on the top surface 41 of the substrate (not shown), with the dielectric layers needed for the desired impedance deposited on top of the ground plane. The signal lines 45 are of course deposited on top of the dielectric in all cases, but in the case where the ground plane is deposited on the top surface of the substrate, etching of the bottom surface of the substrate is obviously not necessary.

Figure 5:
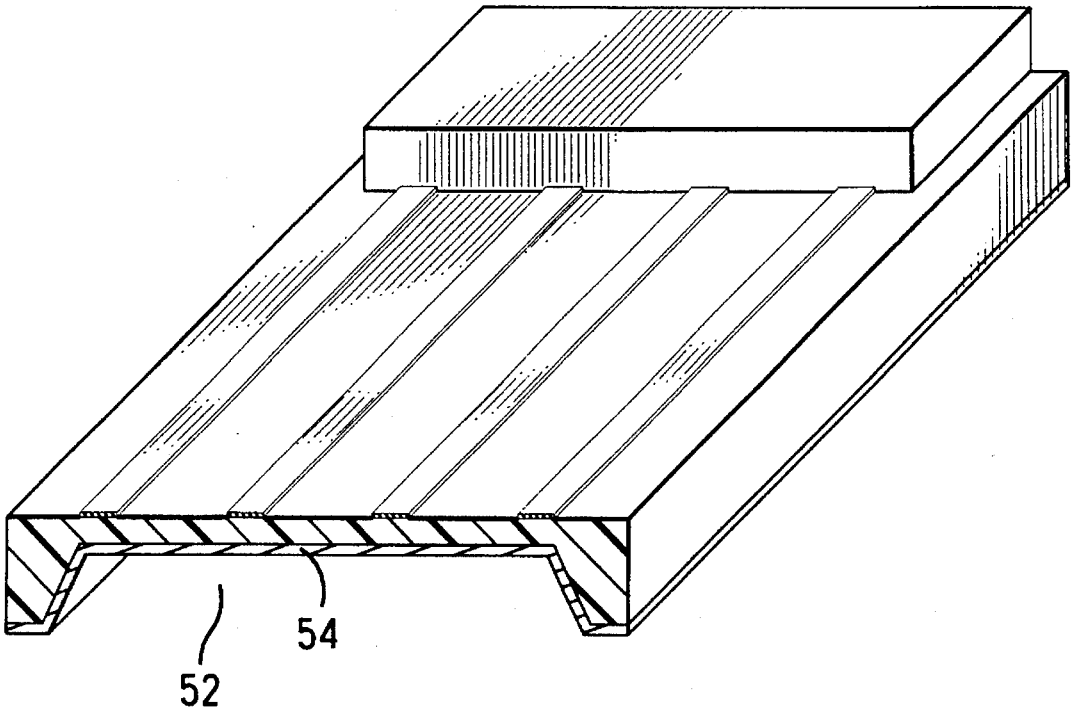
FIG. 5 shows an embodiment of the present invention in which there is at least one wide groove etched into the bottom surface of the substrate.
Figure 6:
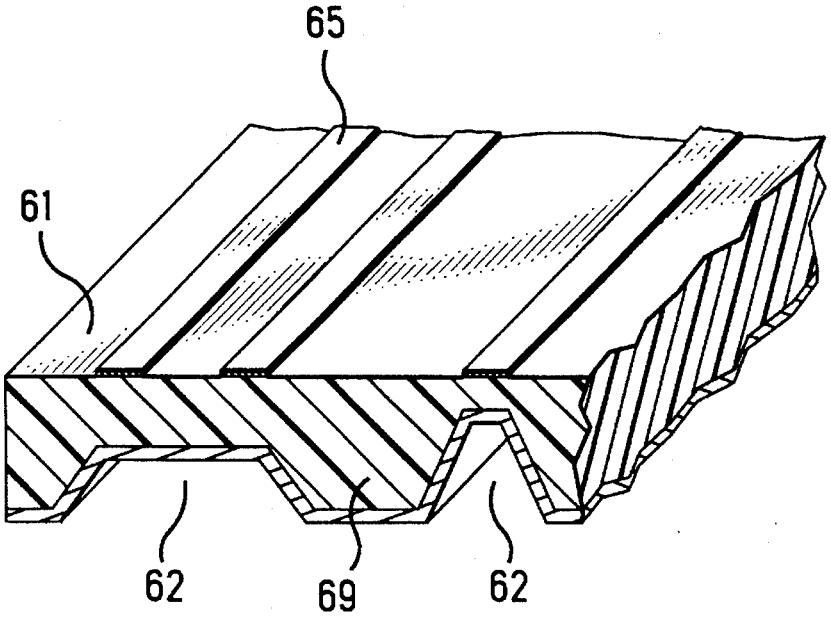
FIG. 6 shows an embodiment of the present invention in which there are multiple wider grooves etched and metal is deposited on each.

Turning to FIG. 5, we see an embodiment of the invention in which there is at least one wide groove 52 etched into the bottom surface of the substrate, with a conductive ground plane 54 deposited thereon. This embodiment would create a substantially equal impedance for each signal line. Also envisioned in this invention is the etching of multiple wider grooves with metal deposited on each. This embodiment is shown in FIG. 6, where each wider groove 62 is positioned on the bottom substrate surface and each provides a given impedance value (depending on the depth of the etch) for a selected number of signal lines 65 which are deposited on the top surface of the substrate 61. The ground plane 64 is then deposited on the bottom of the substrate surface 69 as well as on the grooves.

Various modifications will become apparent to those of ordinary skill in the art. All such variations which basically rely on the teachings which this invention advances are considered within the scope of the invention.

We claim:

1. An electromagnetic waveguide for connecting an optoelectronic device to an electronic device, comprising:

(a.) A silicon substrate having a selected thickness between top and bottom surfaces;

(b.) an optoelectronic device mounted on said top surface;

(c.) a substantially straight groove etched into said bottom surface;

(d.) an electrically conductive layer deposited on said bottom surface and said groove; and (e.) a substantially rectangular strip of electrically conductive material deposited on said top surface, said strip being parallel to said groove and said optoelectronic device and said conductive strip being electrically connected, whereby said substrate, said strip and said conductive layer form a microstrip waveguide for electromagnetic wave propagation.

2. A waveguide as set forth in claim 1, wherein said top surface is of (100) crystallographic orientation.

3. A waveguide as set forth in claim 2, wherein said groove is trapezium shaped and has side walls oriented in the (111) crystallographic planes and a top wall between said side walls, said top wall being substantially parallel to said rectangular strip on said top surface of said substrate.

4. An electromagnetic waveguide for connecting an optoelectronic device to an electronic device, comprising:

(a.) A silicon substrate having a selected thickness between top and bottom surfaces;

(b.) at least one optoelectronic device mounted on said top surface;

(c.) a plurality of substantially parallel grooves etched into said bottom surface;

(d.) an electrically conductive layer deposited on said bottom surface and each of said grooves; and (e.) a plurality of substantially parallel and substantially rectangular strips of electrically conductive material deposited on said top surface of said substrate, each of said strips being substantially parallel to each of said grooves and said optoelectronic device and said rectangular strips being electrically connected, whereby said substrate, said strips and said conductive layer form a microstrip waveguide for electromagnetic wave propagation.

5. A waveguide as set forth in claim 4, wherein said top surface is of (100) crystallographic orientation.

6. A waveguide as set forth in claim 5, wherein said grooves are trapezium shaped and each groove has side walls oriented in the (111) crystallographic planes and a top wall between said side walls, said top wall of each groove being substantially parallel to said rectangular strips on said top surface of said substrate.

7. An electromagnetic waveguide for connecting an optoelectronic device to an electronic device, comprising:

(a.) A silicon substrate having a selected thickness between top and bottom surfaces;

(b.) an optoelectronic device mounted on said top surface;

(c.) a substantially straight groove etched into said bottom surface;

(d.) an electrically conductive layer deposited on said bottom surface and said groove;

(e.) at least one layer of dielectric material deposited on said top surface of said substrate; and (f.) a substantially rectangular strip of electrically conductive material deposited on top of said at least one layer of dielectric material, said strip being parallel to said groove and said optoelectronic device and said conductive strip being electrically connected, whereby said substrate, said strip and said conductive layer form a microstrip waveguide for electromagnetic wave propagation.

8. An electromagnetic waveguide for connecting an optoelectronic device to an electronic device, comprising:

(a.) A silica substrate having a selected thickness between top and bottom surfaces;

(b.) an optoelectronic device mounted on said top surface;

(c.) a substantially straight groove etched into said bottom surface;

(d.) an electrically conductive layer deposited on said bottom surface and said groove; and (e.) a substantially rectangular strip of electrically conductive material deposited on said top surface, said strip being parallel to said groove and said optoelectronic device and said conductive strip being electrically connected, whereby said substrate, said strip and said conductive surface form a microstrip waveguide for electromagnetic wave propagation.

9. An electromagnetic waveguide for connecting an optoelectronic device to an electronic device, comprising:

(a.) A silica substrate having a selected thickness between top and bottom surfaces;

(b.) at least one optoelectronic device mounted on said top surface;

(c.) a plurality of substantially parallel grooves etched into said bottom surface;

(d.) an electrically conductive layer deposited on said bottom surface and each of said grooves; and (e.) a plurality of substantially parallel and substantially rectangular strips of electrically conductive material deposited on said top surface of said substrate, each of said strips being substantially parallel to each of said grooves and said optoelectronic device and said rectangular strips being electrically connected, whereby said substrate, said strips and said conductive surface form a microstrip waveguide for electromagnetic wave propagation.

* * * * *